US005398009A

United States Patent [19]

Kudo et al.

[11] Patent Number: 5,398,009

[45] Date of Patent: Mar. 14, 1995

[54] WAVEGUIDE FILTER WITH COAXIAL/WAVEGUIDE MODE CONVERSION

[75] Inventors: Kenichi Kudo; Hiroyuki Sogo; Takehiro Shimizu; Masanori Fukuda, all of Kawasaki, Japan

[73] Assignee: Fujitsu Limited, Kanagawa, Japan

[21] Appl. No.: 945,921

[22] Filed: Sep. 17, 1992

[30] Foreign Application Priority Data

Sep. 18, 1991 [JP] Japan ..... 3-237961

[51] Int. Cl.[6] ..... H01P 1/207

[52] U.S. Cl. ..... 333/208; 333/239

[58] Field of Search ..... 333/26, 208–212, 333/239, 248, 251

[56] References Cited

U.S. PATENT DOCUMENTS

| | | | |
|---|---|---|---|
| 2,588,103 | 3/1952 | Fox | 333/209 |
| 2,629,015 | 2/1953 | Reed | 333/208 |
| 2,829,352 | 4/1958 | Hennies et al. | 333/233 |
| 2,975,380 | 3/1961 | Scharfman | 333/21 A |
| 2,985,852 | 5/1961 | Cowcher et al. | 333/251 X |
| 3,617,956 | 11/1971 | Bastikar | 333/212 |
| 3,657,670 | 4/1972 | Kitazume et al. | 333/209 |
| 4,631,503 | 12/1986 | Brown | 333/24.1 |

FOREIGN PATENT DOCUMENTS

| | | |
|---|---|---|
| 0167302 | 1/1986 | European Pat. Off. . |
| 0251085 | 1/1988 | European Pat. Off. . |
| 2036042 | 1/1972 | Germany . |

OTHER PUBLICATIONS

*Patent Abstracts of Japan,* vol. 6, No. 251 (E-147) 10 Dec. 1982 & JP-A-57 148403 (Yagi Antenna K.K.) 13 Sep. 1982.

*Primary Examiner*—Seungsook Ham
*Attorney, Agent, or Firm*—Staas & Halsey

[57] ABSTRACT

In order to improve filter loss of a waveguide filter having coaxial/waveguide mode conversion parts at its ends, conductor posts bridging a space between two long sides of the waveguide are provided between the parts and the ends. The conductor posts have sufficient thickness and remain close enough to each other and to short ends of the waveguide that a partition plane including axes of the conductor posts can be regarded as an imaginary short plane. The conductor posts are located so that the partition plane is positioned at a distance $\lambda/4 \times n$ ($n=1, 3, 5 \ldots$) from the coaxial/waveguide mode conversion part.

3 Claims, 7 Drawing Sheets

WAVEGUIDE FILTER WITH COAXIAL/WAVEGUIDE MODE CONVERSION

BACKGROUND OF THE INVENTION

1. Field of the Invention

The present invention relates to a waveguide filter provided with coaxial/waveguide mode conversion parts for converting a transmission mode between a coaxial and a waveguide, in One or both ends thereof.

2. Description of the Related Art

A waveguide filter one or both ends of which are to be coupled through coaxial lines to other circuit elements is provided with coaxial/waveguide mode conversion parts in one or both ends thereof. In an end of the waveguide filter where the coaxial/waveguide mode conversion part is provided, the waveguide is sealed by inserting a metal block into an open end of the waveguide and by screwing the waveguide on the metal block.

Though a cross section of the metal block is made so as to fit a cross section of a space bounded by the waveguide in order to prevent leakage of electric waves, gaps tend to be formed between the metal block and inner walls of the waveguide because of deflection of the walls of the waveguide that are not secured by screws, and filter loss tends to be increased because of leakage of the electric wave through the gaps. Though conductive adhesive or copper foil has been used to fill the gaps, attenuation of the leaked electric waves is limited to about 60 dB. Thus, it has been difficult and costly to reduce the leakage to a desired level.

SUMMARY OF THE INVENTION

It is an object of the present invention to provide a waveguide filter with coaxial/waveguide mode conversion parts, wherein leakage of an electric wave from ends of the waveguide filter can be effectively reduced.

In accordance with the present invention, there is provided a waveguide filter, comprising: a waveguide having two opposite long sides and two opposite short sides, a coaxial/waveguide mode conversion part provided at least one end of the waveguide, for converting a transmission mode between a coaxial mode and a waveguide mode, and more than one conductor post each bridging a space between the two opposite long sides and located between the coaxial/waveguide mode conversion part and the end at which the coaxial/waveguide mode conversion part is provided.

DESCRIPTION OF THE PREFERRED EMBODIMENTS

Before describing the preferred embodiments according to the present invention, examples of the related art are given with reference to the accompanying drawings.

Figure 1:
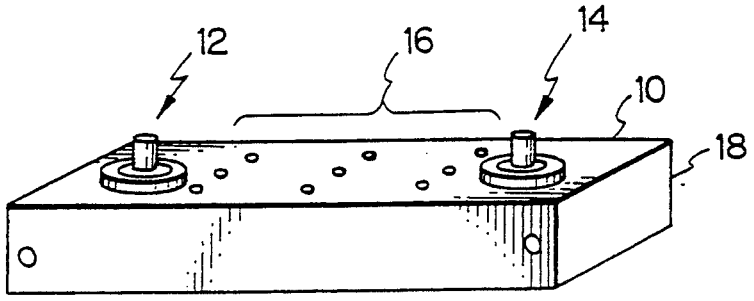
Fig. 1 PRIOR ART
FIG. 1 is a perspective view of a conventional waveguide bandpass filter having coaxial input/output ports.

FIG. 1 is a perspective view of a conventional waveguide bandpass filter having coaxial input/output ports. The waveguide filter includes a waveguide 10 and coaxial/waveguide mode conversion parts 12 and 14 for inputting and outputting signals through coaxial cables.

Figure 2:
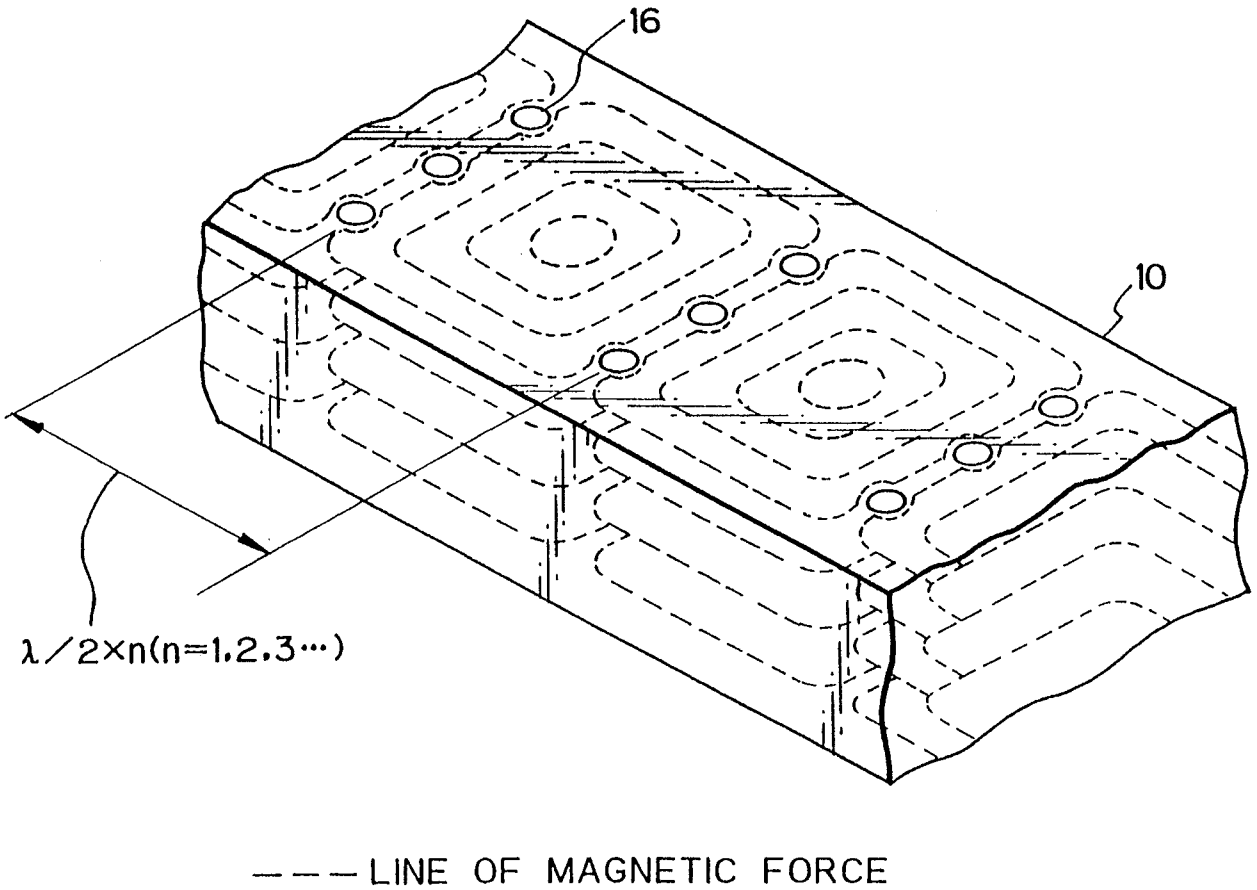
Fig. 2 PRIOR ART
FIG. 2 is a perspective view for explaining an operation of a waveguide bandpass filter.

A space bounded by the waveguide 10 is divided by a plurality of partitions each composed of a plurality of conductor posts 16 and longitudinally spaced at prescribed intervals, to form a multiple-stage bandpass filter. In the example of FIG. 1, a space bounded by the waveguide 10 is divided by three partitions each composed of three conductor posts 16 and longitudinally spaced at intervals of $\lambda/2\times n$ ($n=1, 2, 3 \ldots$) where $\lambda$ is a wavelength of a signal allowed to pass through. The conductor posts 16 are thinner than the thinnest conductor posts that would make susceptance of the partitions a value corresponding to imaginary short planes with respect to the signal allowed to pass through, in order to allow leakage of that signal. Thus, the signal having a wavelength $\lambda$ forms a standing wave as shown in FIG. 2, but signals having a wavelength not equal to $\lambda$ cannot form the standing wave, and thus the waveguide 10 functions as a bandpass filter.

Figure 3:
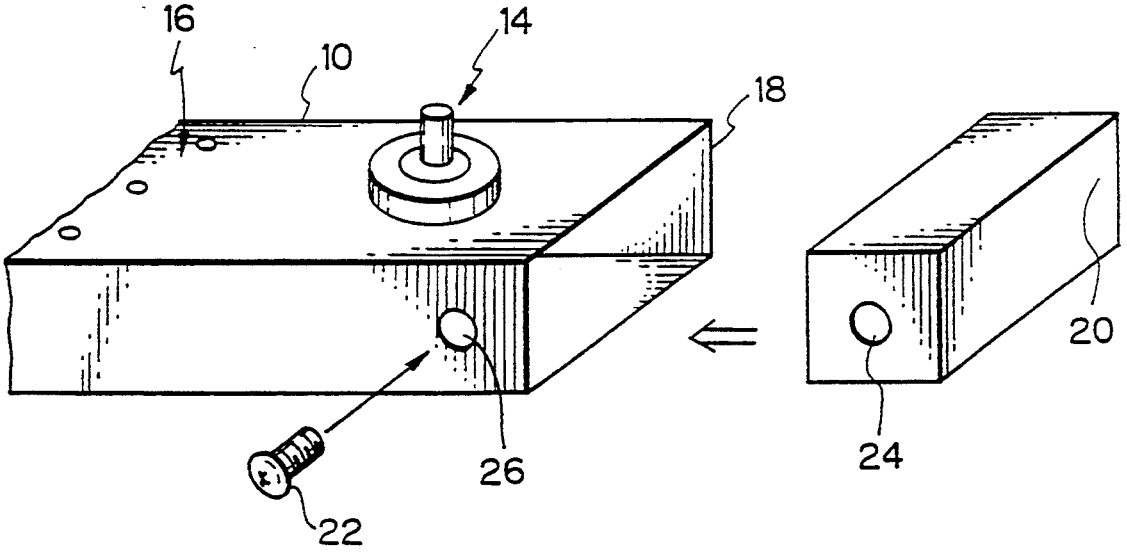
Fig. 3 PRIOR ART
FIG. 3 is a perspective view explaining a conventional method of sealing ends of a waveguide filter.

As shown in FIG. 3, the ends 18 of the waveguide 10 are sealed by inserting metal blocks 20, and the metal block 20 is fixed to the waveguide 10 by screwing the side walls of the waveguide 10 to the inserted metal block 20 with screws 22 engaging with screw holes 24 formed in the metal block 20, through holes 26 of the side walls of the waveguide 10.

Figure 4A:
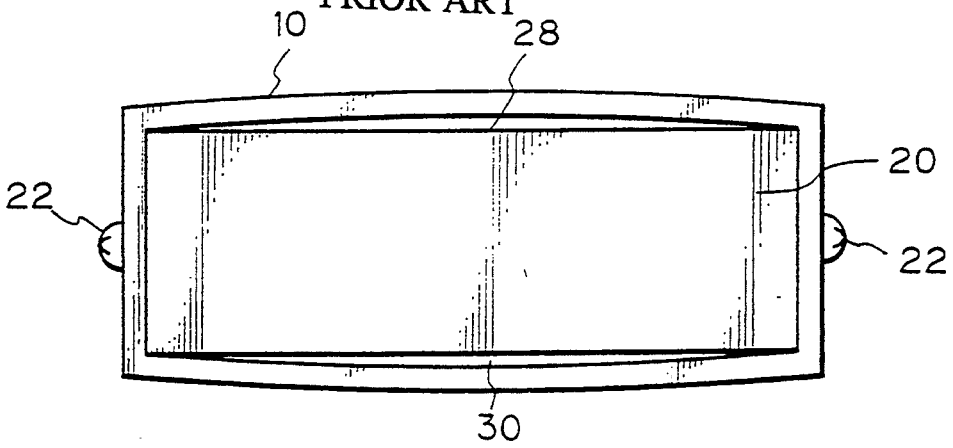
Fig. 4A PRIOR ART
FIGS. 4A to 4C are elevational views of the conventional waveguide filter for explaining a problem thereof.
Figure 4B:
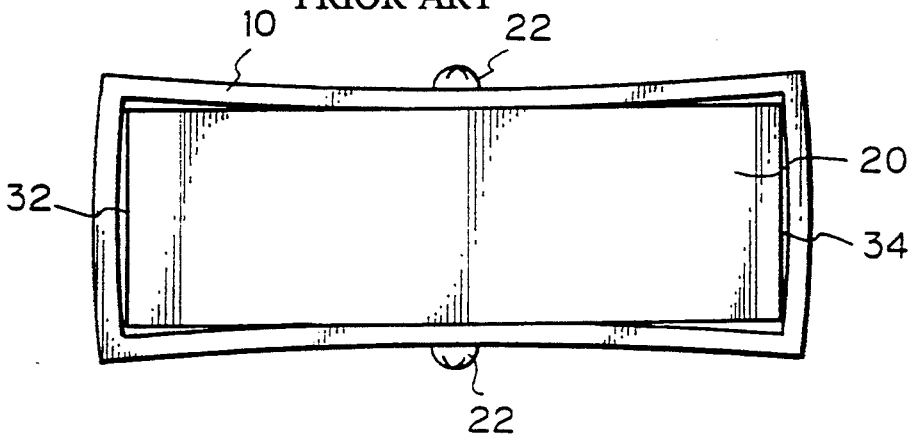
Fig. 4B PRIOR ART
Figure 4C:
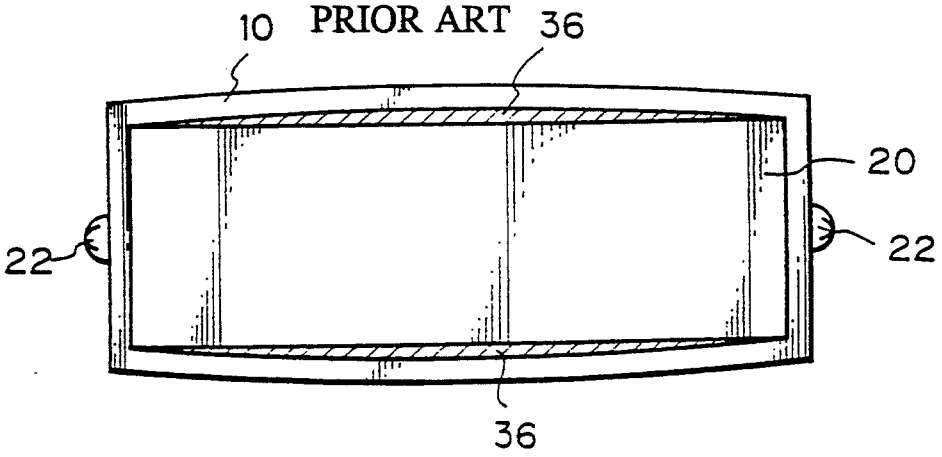
Fig. 4C PRIOR ART

As shown in FIGS. 4A and 4B, though a cross section of the metal block 20 is made so as to fit a cross section of a space bounded by the waveguide 10, gaps 28 and 30, or 32 and 34, tend to be formed between the metal block 20 and the waveguide 10 because of deflection of the side walls that are not secured by screws, and the gaps thus formed increase filter loss. Although the gaps may be filled with conductive adhesive or copper foil 36 as shown in FIG. 4C, attenuation of the leaked electric waves is limited to about 60dB, and it has been difficult and costly to reduce the leakage to a desired level.

The preferred embodiments of the present invention will now be described with reference to the accompanying drawings.

Figure 5A:
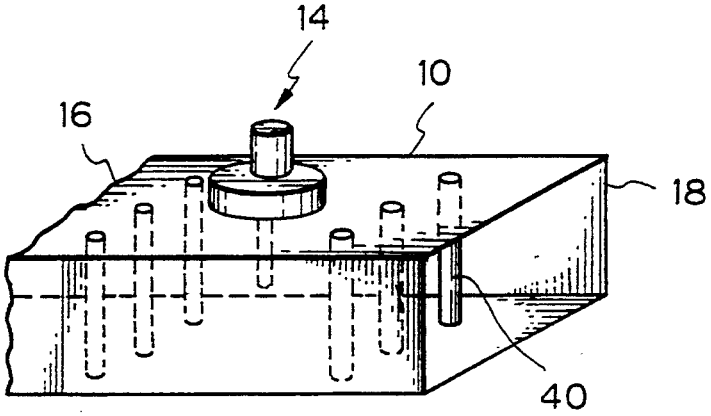
FIG. 5A is a perspective view of an end of a waveguide filter according to an embodiment of the present invention.
Figure 5B:
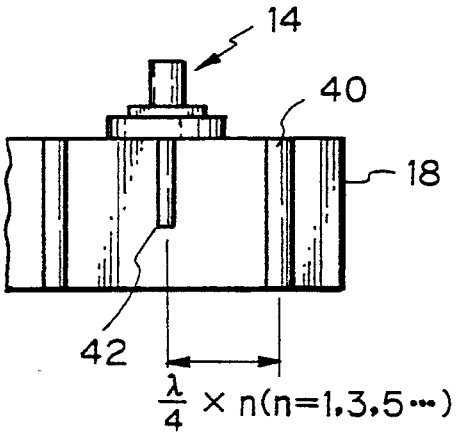
FIG. 5B is a longitudinal sectional view of the end.
Figure 5C:
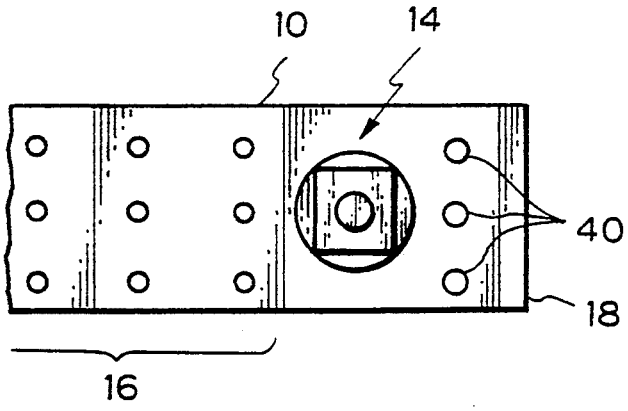
FIG. 5C is a plan view of the end.

FIGS. 5A to 5C show one end of a waveguide bandpass filter according to a first embodiment of the present invention, where FIG. 5A, FIG. 5B and FIG. 5C are a perspective view, a longitudinal sectional view, and a plan view, respectively.

More than one, for example, three conductor posts 40 bridging a space between two opposite long sides of the waveguide 10 are provided between the coaxial/waveguide mode conversion part 14 and the end 18 of the waveguide 10.

The conductor posts 40 are located so that a partition defined by a plane including axes of the conductor posts 40 is positioned at a distance $\lambda/4\times n$ ($n=1, 3, 5 \ldots$) from an inner conductor 42 of the coaxial/waveguide mode conversion part 14, as shown in FIG. 5B.

In addition, the conductor posts 40 have sufficient thickness and remain sufficiently close to each other and to the short sides of the waveguide so that susceptance of the partition represents a Value corresponding to an imaginary short plane with respect to the signal allowed to pass through the filter. Thus, the signal having a wavelength $\lambda$ is prevented from passing through by the partition composed of the conductor posts 40, and leakage of electric waves from the open end 18 is remarkably reduced.

Figure 6A:
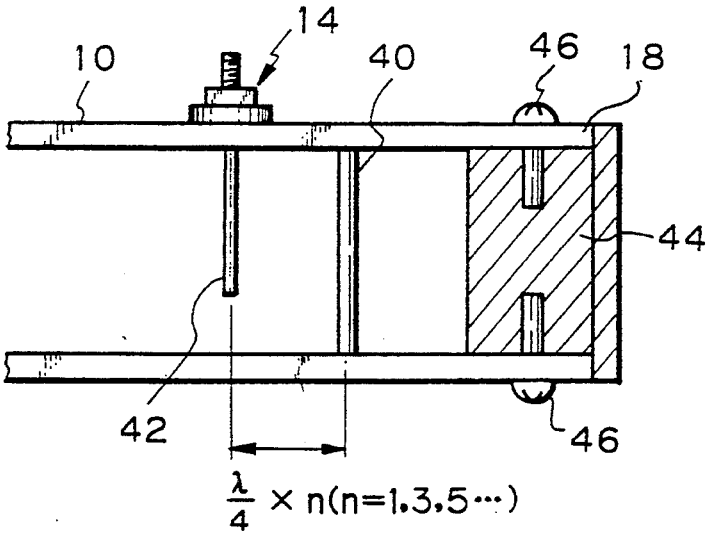
FIG. 6A is a longitudinal sectional view of an end of a waveguide filter according to another embodiment of the present invention.
Figure 6B:
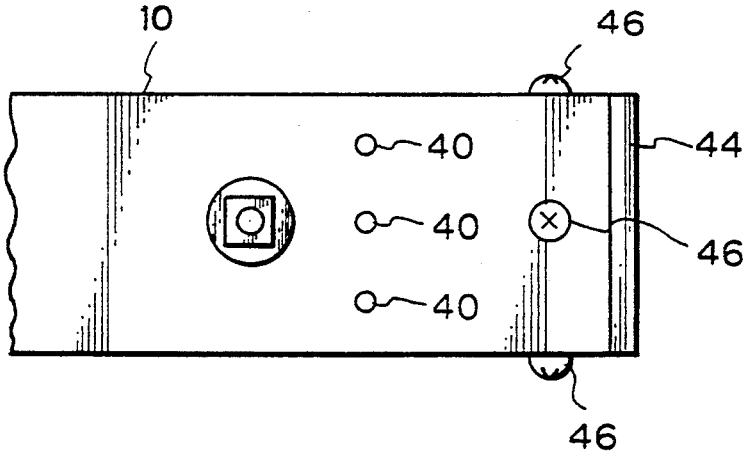
FIG. 6B is a plan view of the end.
Figure 6C:
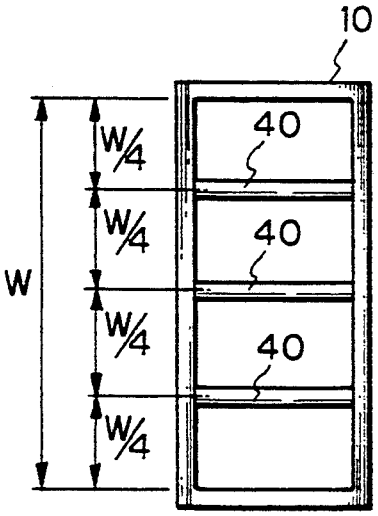
FIG. 6C is a transverse sectional view of the end.

FIGS. 6A to 6C show one end of a waveguide filter according to another embodiment of the present invention, where FIGS. 6A, 6B and 6C are a longitudinal sectional view, a plan view, and a transverse sectional view at a position of the conductor posts 40, respectively. Similarly to that of FIGS. 5A to 5C, the waveguide filter shown in FIGS. 6A to 6C includes three conductor posts 40 for preventing the signal allowed to pass through the filter from leaking out from the end. The conductor posts 40 are laterally positioned at equal intervals of W/4 as shown in FIG. 6C, where W is a width of the waveguide. In addition, the waveguide filter of FIGS. 6A to 6C includes a metal block 44 for sealing the end of the waveguide filter. Since electric waves leaking out from the end are reduced by the conductor posts 40 by about 70–80 dB, sealing with the metal block 44 is not essential for preventing the leakage of the electric wave but preferable from the point of view of prevention of deterioration of filter characteristics caused by invasion of dust or disturbance by external electric waves. Nevertheless, filling material as shown in FIG. 4C is not necessary.

Figure 7:
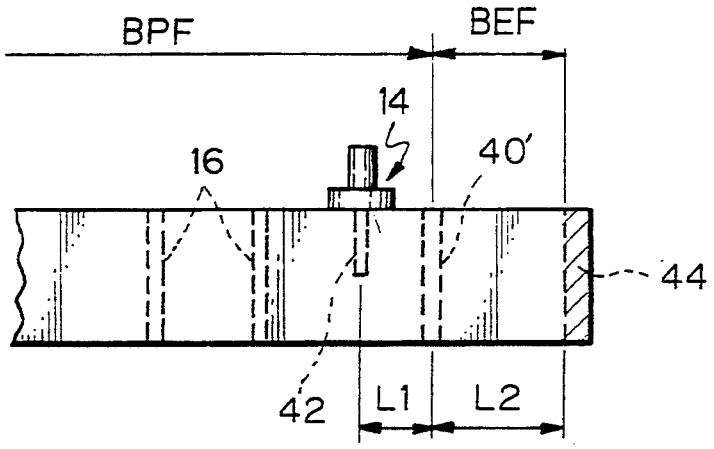
FIG. 7 is a side view of an end of a waveguide filter according to another embodiment of the present invention.

FIG. 7 shows a waveguide filter according to another embodiment of the present invention, wherein a band elimination filter (BEF) is formed in the end of the band pass filter (BPF). In FIG. 7, the conductor posts 40' are provided between a coaxial/waveguide mode conversion part 14 and a metal block 44 at a distance L1 equal to $\lambda/4\times n$ ($n=1, 3, 5 \ldots$) from the inner conductor 42 of the coaxial/waveguide mode conversion part 14, similar to the conductor posts 40 of FIGS. 6A to 6C. However, the conductor posts 40' are made slightly thinner than the thinnest conductor posts that would make a perfect imaginary short plane, and the distance L2 between the conductor posts 40' and the metal block 44 is made equal to $\lambda'/2\times n$ ($n=1, 2, 3 \ldots$) where $\lambda'$ is a wavelength of an electric wave to be eliminated, for example, that of a local frequency deviating from the pass band frequency by 70 $MH_z$. Thus, an electric wave of $\lambda'$ included in electric waves having leaked through the conductor posts 40' is absorbed into a resonator having a length of L2 ($=\lambda'/2\times n$ ($n=1, 2, 3 \ldots$)), to thereby eliminate the undesirable electric wave.

Since the distance L1 between the inner conductor 42 and the conductor posts 40' is $\lambda/4\times n$ ($n=1, 3, 5 \ldots$), the BEF portion is regarded as an open end with respect to a center frequency of the BPF, and therefore, the BEF does not affect the characteristics of the BPF.

Figure 8:
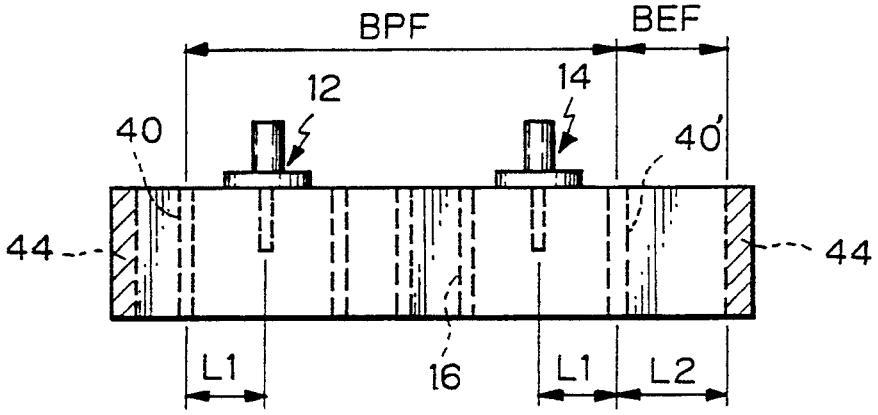
FIG. 8 is a side view of a waveguide filter according to another embodiment of the present invention.

FIG. 8 shows an example of the waveguide filter according to the present invention, wherein the BEF is formed in one end of the BPF.

Figure 9:
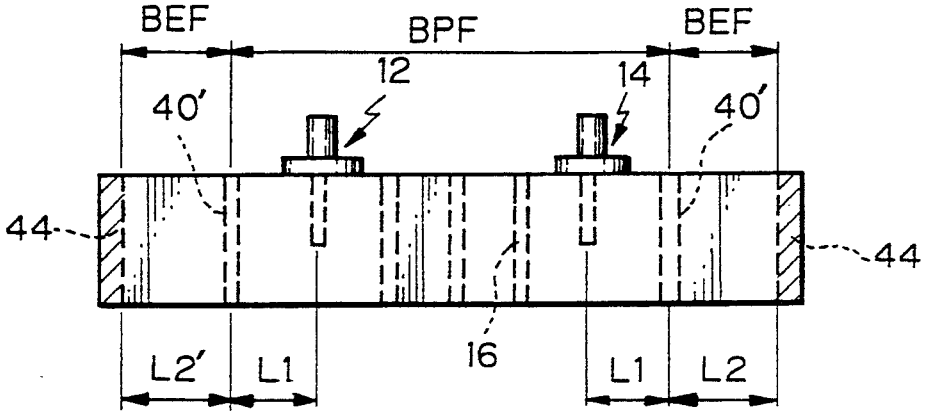
FIG. 9 is a side view of a waveguide filter according to another embodiment of the present invention.

FIG. 9 shows another example of the waveguide filter according to the present invention wherein two BEF's are formed, one in each of the two ends of the BPF. If the distances L2 and L2' between the conductor posts 40' and the metal blocks 44 are equal to each other, in other words, if the center frequencies of the two BEFs are equal to each other, greater elimination of an unnecessary frequency is obtained. If the distances L2 and L2' are different from each other, elimination of two different frequencies is obtained. In addition, if the distances L2 and L2' are set so that the elimination frequencies are close to each other, a BEF having a desired elimination band is obtained.

Figure 10A:
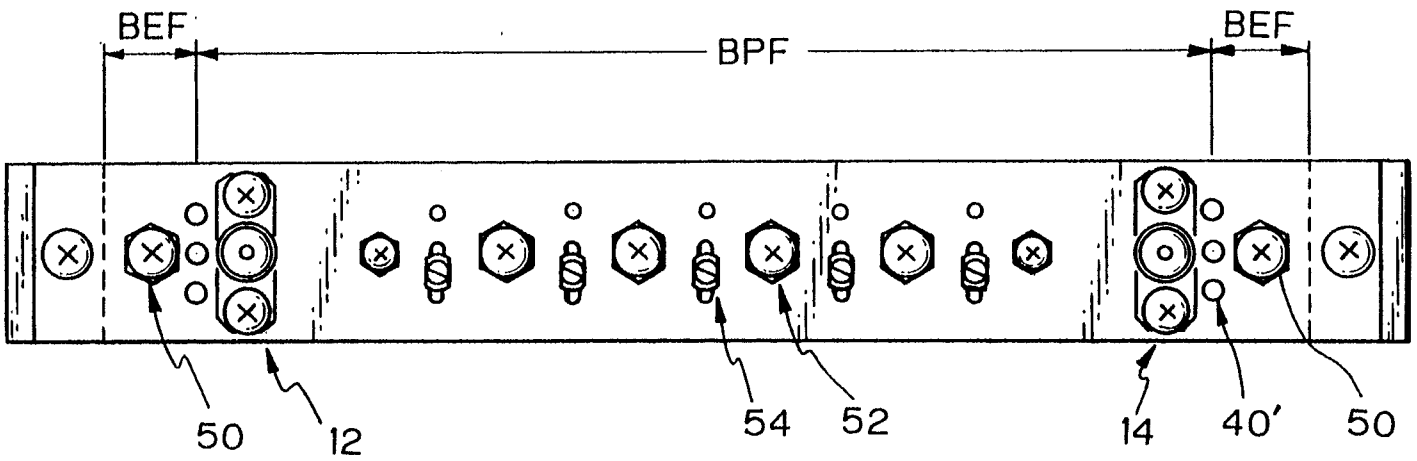
FIG. 10A is a plan view of the waveguide filter of FIG. 9 showing a detailed construction thereof.
Figure 10B:
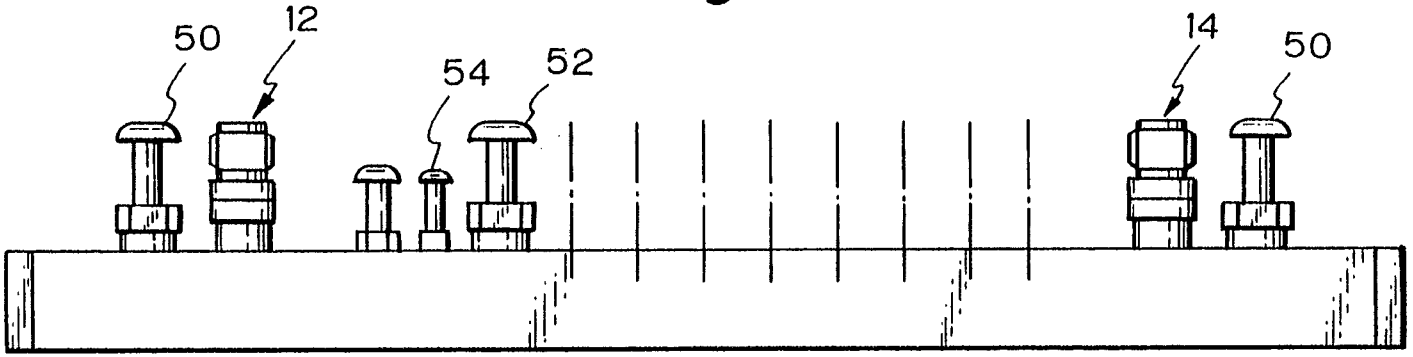
FIG. 10B is a side view of the waveguide filter of FIG. 10A.

FIGS. 10A and 10B show a detailed construction of the waveguide filter of FIG. 9, where FIG. 10A is a plan view and FIG. 10B is a side view. In FIGS. 10A and 10B, adjusting screws 50 for varying center frequencies of the BEF are shown. Screws 52 are provided for adjusting the center frequency of the BPF and screws 54 are provided for adjusting a degree of coupling.

We claim:

1. A waveguide filter, comprising:

a waveguide having two opposite long sides and two opposite short sides which define first and second ends and an interior region;

a bandpass filter provided in the interior region of the waveguide;

a coaxial/waveguide mode conversion part provided in the waveguide, for converting a transmission mode between a coaxial mode and a waveguide mode, the bandpass filter being located on a first side of the coaxial/waveguide mode conversion part, toward the first end of the waveguide;

a plurality of conductor posts which together bridge a space between the two opposite long sides, the conductor posts being located on a second side of the coaxial/waveguide mode conversion part, toward the second end of the waveguide;

a conductor block inserted into the second end of the waveguide to thereby seal the second end, the distance between a partition plane defined by the conductor posts and the conductor block being substantially $\lambda'/2\times n$ ($n=1, 2, 3 \ldots$) where $\lambda'/$ is the wavelength of an electric wave to be eliminated.

2. A waveguide filter, as claimed in claim 1, wherein further conductor posts, defining a further partition plane, and a further conductor block are provided at the first end of the waveguide so that the bandpass filter is toward the second end of the waveguide relative to the further conductor posts and the further conductor block, and the distance between the partition plane and the conductor block is substantially equal to the distance between the further partition plane and the further conductor block.

3. A waveguide filter, as claimed in claim 1, wherein further conductor posts, defining a further partition plane, and a further conductor block are provided at the first end of the waveguide so that the bandpass filter is toward the second end of the waveguide relative to the further conductor posts and the further conductor block, and the distance between the partition plane and the conductor block is substantially different from the distance between the further partition plane and the further conductor block.

* * * * *

UNITED STATES PATENT AND TRADEMARK OFFICE

CERTIFICATE OF CORRECTION

PATENT NO. : 5,398,009

DATED : March 14, 1995

INVENTOR(S) : Kenichi KUDO et al.

It is certified that error appears in the above-indentified patent and that said Letters Patent is hereby corrected as shown below:

Col. 1, line 11, change "One" to --one--.

Col. 3, line 16, change "Value" to --value--.

Col. 4, line 46, change "λ'/ is" to --λ' is--.

Signed and Sealed this

Twenty-third Day of May, 1995

*Attest:*

*Attesting Officer*

BRUCE LEHMAN

*Commissioner of Patents and Trademarks*